US011084005B1

(12) United States Patent
Contorno

(10) Patent No.: US 11,084,005 B1
(45) Date of Patent: Aug. 10, 2021

(54) COOLER LID WITH INTEGRAL MIXING PADDLE

(71) Applicant: Donnie Sam Contorno, Helena, AL (US)

(72) Inventor: Donnie Sam Contorno, Helena, AL (US)

( * ) Notice: Subject to any disclaimer, the term of this patent is extended or adjusted under 35 U.S.C. 154(b) by 623 days.

(21) Appl. No.: 15/589,679

(22) Filed: May 8, 2017

Related U.S. Application Data

(60) Provisional application No. 62/332,671, filed on May 6, 2016.

(51) Int. Cl.

| | |
|---|---|
| ***B01F 7/18*** | (2006.01) |
| ***B01F 7/00*** | (2006.01) |
| ***B01F 15/00*** | (2006.01) |
| ***B01F 15/02*** | (2006.01) |
| ***B01F 3/12*** | (2006.01) |

(52) U.S. Cl.
CPC ..... *B01F 7/18* (2013.01); *B01F 3/1221* (2013.01); *B01F 7/0025* (2013.01); *B01F 15/00506* (2013.01); *B01F 15/026* (2013.01); *B01F 2215/0022* (2013.01)

(58) Field of Classification Search
CPC ..... B01F 7/18; B01F 15/026; B01F 3/1221; B01F 7/0025; B01F 15/00506; B01F 2215/0022
USPC ..... 366/129
See application file for complete search history.

(56) References Cited

U.S. PATENT DOCUMENTS

| | | | | |
|---|---|---|---|---|
| 1,775,345 | A * | 9/1930 | Henschel | B01F 7/1695 366/192 |
| 2,719,703 | A * | 10/1955 | Boakes | A47J 36/165 366/244 |
| 4,961,647 | A * | 10/1990 | Coutts | B01F 13/002 366/139 |
| 5,094,543 | A * | 3/1992 | Mursa | B01F 7/1695 220/23.87 |
| 7,384,188 | B2 * | 6/2008 | Waggoner | B01F 7/00133 366/247 |
| 2001/0043972 | A1 * | 11/2001 | Tomlinson | B65B 1/06 426/115 |
| 2010/0302897 | A1 * | 12/2010 | George | A47J 43/1025 366/130 |

(Continued)

FOREIGN PATENT DOCUMENTS

CA 2270314 A1 * 10/2000 ..... E02D 29/1409

*Primary Examiner* — Huy Tram Nguyen
(74) *Attorney, Agent, or Firm* — C. Brandon Browning; Maynard, Cooper & Gale, PC

(57) ABSTRACT

An apparatus configured for attaching to a conventional cooler and mixing the contents therein, the apparatus including a lid assembly integrated with a mixing assembly. The lid assembly includes a lid having both a hole and an opening to allow the addition of contents to the container and a cover that can be positioned over the opening and secured to the lid. The mixing assembly is integrated with the lid assembly through the hole and includes a centering guide positioned at the bottom of the container, a mixing paddle coupled to the top portion of the centering guide, and a handle operatively coupled to the mixing paddle through the hole. After contents are added to the container through the opening, the cover is positioned over the opening and securely coupled to the lid. The handle is operated to cause the mixing paddle to stir the contents of the container.

15 Claims, 8 Drawing Sheets

(56) References Cited

U.S. PATENT DOCUMENTS

2016/0121283 A1* 5/2016 Tannous ..... B01F 15/00506
222/226

* cited by examiner 10
26
36
30
25
35
34
32

30
38
33
32

36
40
30
42

26

30
34

25
28

10
26
28
25
30
35
34
32

26
31
25
30
34

25
28
26

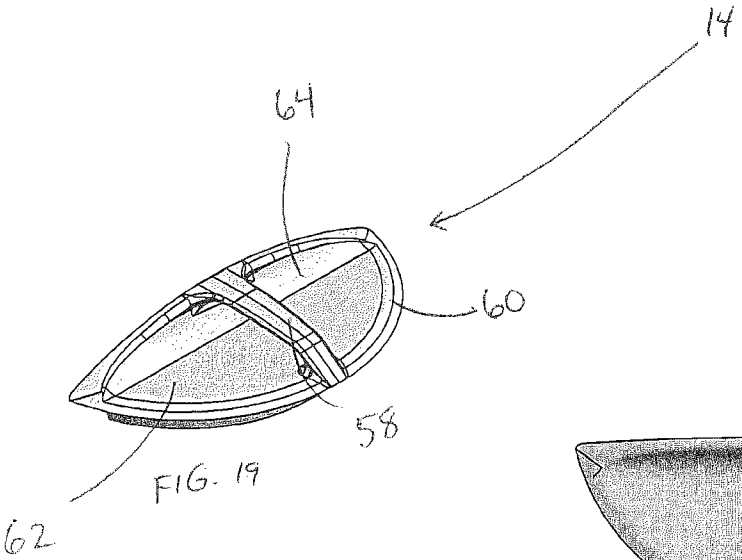
FIG. 19
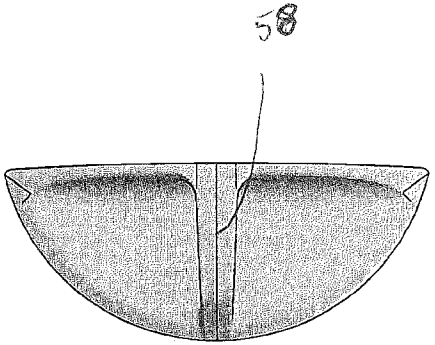
FIG. 20
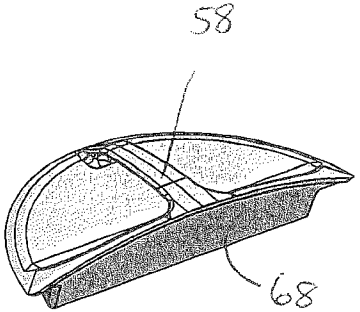
FIG. 21
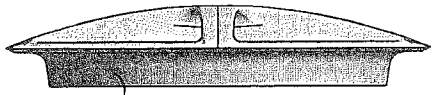
FIG. 22
FIG. 23
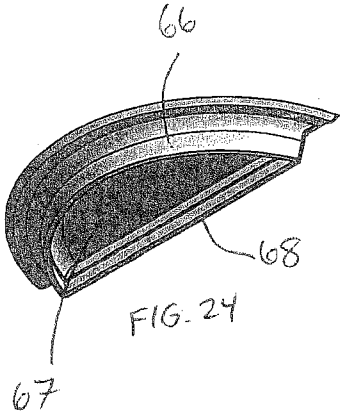
FIG. 24

COOLER LID WITH INTEGRAL MIXING PADDLE

RELATED APPLICATIONS

This application claims priority to U.S. Provisional Application 62/332,671, filed on May 6, 2016, and titled "Cooler Lid with Integral Mixing Paddle," the entire contents of which are incorporated herein by reference.

FIELD OF THE INVENTION

The present disclosure is directed to an apparatus for mixing the contents of a container, and more particularly, to an assembly configured for attaching to a conventional cooler and mixing the contents therein.

SUMMARY OF THE INVENTION

The present disclosure is directed to an apparatus configured for attaching to a container and mixing the contents therein. The apparatus includes a lid assembly with a lid containing an opening to add contents to the container and a cover that can be positioned over the opening and secured to the lid after the contents have been added to the container. The apparatus also includes a mixing assembly with a centering guide having a top side and a bottom side and configured for positioning at the bottom of the inside of the container, a mixing paddle coupled to the top side of the centering guide, and a handle operatively coupled to the mixing paddle through a small hole in the lid. After contents are added to the container through the opening, the cover is positioned over the opening and coupled to the lid, and the handle is operated to cause the mixing paddle to stir the contents of the container.

In an exemplary embodiment, the apparatus is configured for attaching to a conventional five-gallon or ten-gallon cooler. The centering guide is positioned at the bottom of the inside of the cooler, and the mixing paddle is coupled to a bearing on the top side of the centering guide. The lid is positioned over the top of the cooler, and the handle is mechanically coupled to the mixing paddle through a hole in the lid. Once the handle is mechanically coupled to the mixing paddle, the lid is securely coupled to the top of the cooler. Contents are added to the cooler through the opening in the lid. The cover is positioned over the opening and securely coupled to the lid, and the handle is turned to cause the mixing paddle to rotate around the bottom of the cooler and stir the contents therein.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

FIGS. 19-24 depict various views of the cover.

DETAILED DESCRIPTION OF THE DRAWINGS

Figures 1, 2, 3, 4:
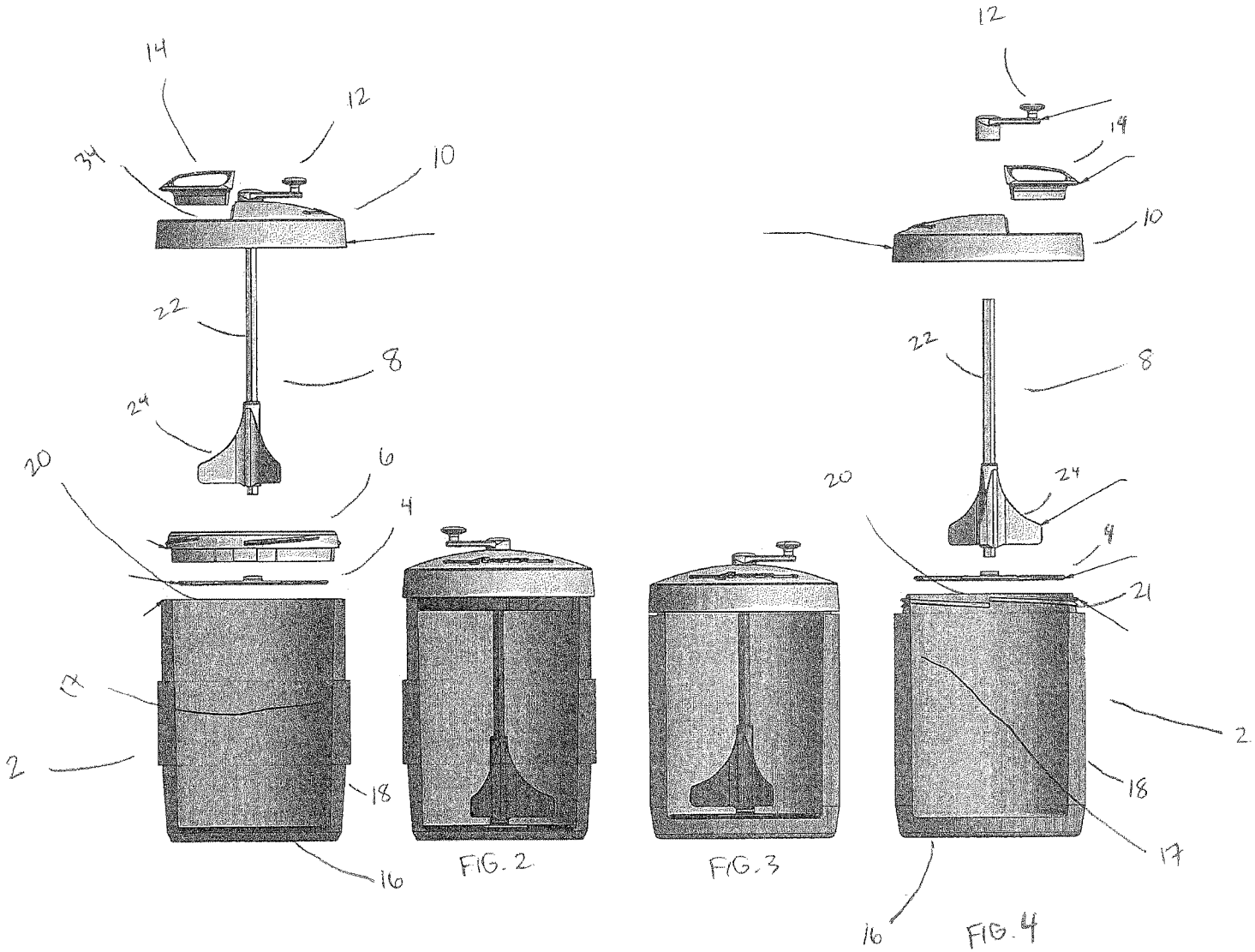
FIG. 1 is an exploded elevation view of the present invention configured for attaching to a non-threaded cooler.
FIG. 2 is an elevation view of the apparatus of FIG. 1.
FIG. 3 is an elevation view of the present invention configured for attaching to a threaded cooler.
FIG. 4 is an exploded elevation view of the apparatus of FIG. 3.

The present disclosure is directed to an apparatus configured for attaching to a container and mixing the contents therein. FIGS. 1 and 4 depict exploded elevation views of the present invention. The apparatus includes a lid assembly with a lid 10 containing an opening 34 to add contents to a container 2 and a cover 14 that can be positioned over the opening 34 and secured to the lid 10 after the contents have been added to the container 2. The apparatus also includes a mixing assembly with a centering guide 4 having a top side and a bottom side and configured for positioning at the bottom of the inside of the container 2, a mixing paddle 8 coupled to the centering guide 4, and a handle 12 operatively coupled to the mixing paddle 8 through the lid 10. The lid 10 is securely coupled to the top of the container 2, and contents are added through the opening 34. After contents are added to the container 2, the cover 14 is positioned over the opening 34 and coupled to the lid 10, and the handle 12 is operated to cause the mixing paddle to stir the contents of the container 2.

Figures 5, 6, 7, 8, 9, 10, 11, 12, 13:
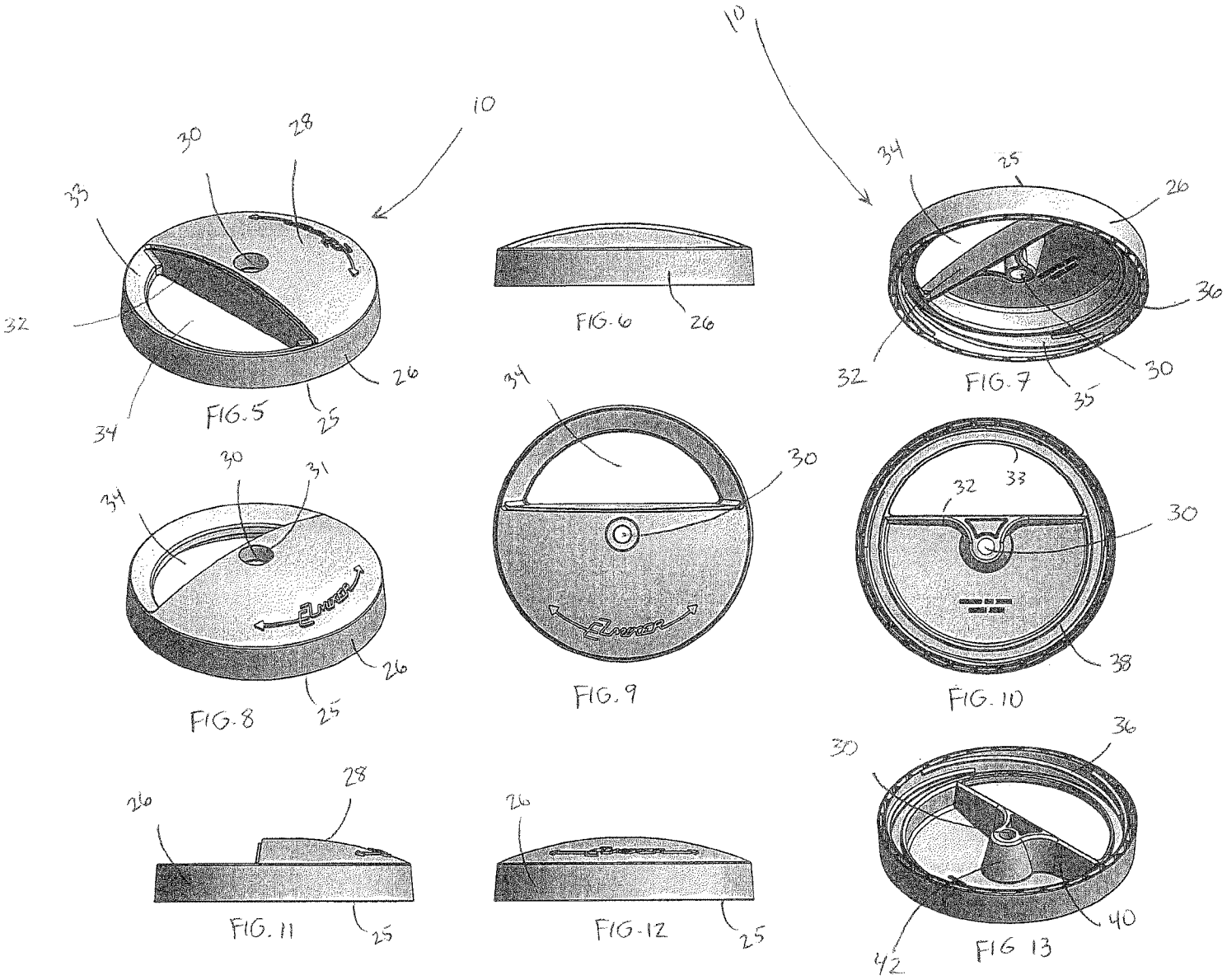
FIGS. 5-13 depict various views of the lid.
Figure 18:
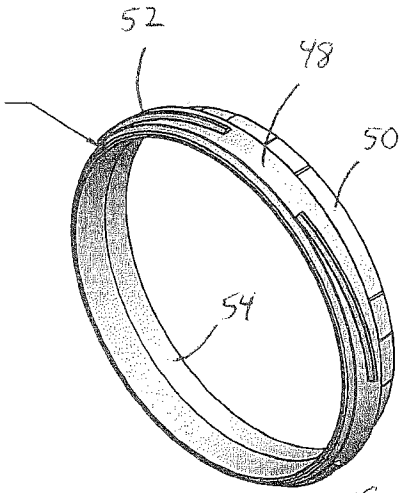
FIGS. 14-18 depict various views of the thread adapter.
Figure 17:
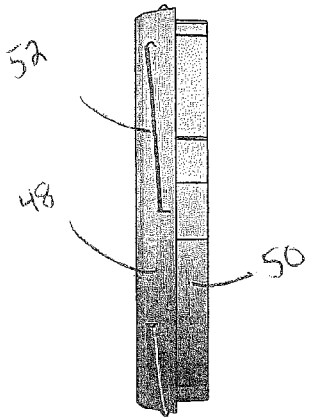
Figure 16:
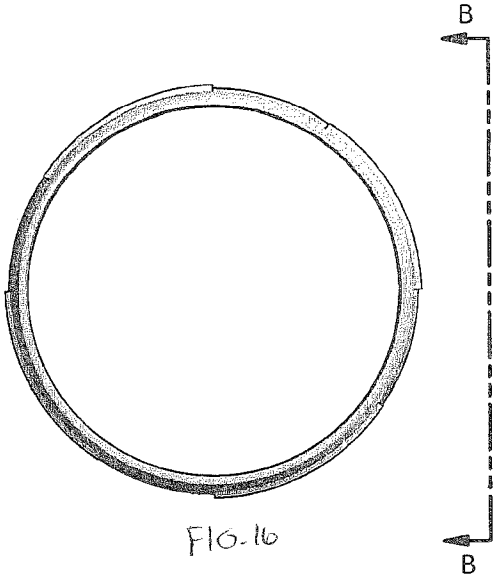

As shown in FIGS. 5 and 10, the lid 10 includes an opening 34, a hole 30, an outer rim 25, and an inner rim 38. In the exemplary embodiments shown in FIGS. 11 and 12, the lid 10 is raised. The opening 34 allows for the efficient addition of contents to the container. The opening 34 has an inside edge 32 and an outside edge 33. The opening 34 allows contents to be added to the container 2 when the lid 10 is securely coupled to the top of the container 2 without removing the lid 10. As shown in FIG. 10, the inside edge 32 and outside edge 33 are contiguous with the inner rim 38. The inside edge 32 and outside edge 33 are configured for coupling to the cover 14. For example, in the exemplary embodiment shown in FIG. 5, the inside edge 32 is flat and the outside edge 33 is concave so that the cover 14 can be securely coupled to the opening 34. As shown in FIG. 8, the hole 30 has an inside portion 31 through which the mixing paddle 8 and handle 12 are operatively coupled. In the exemplary embodiment depicted in FIG. 9, the hole is located in the center of the lid 10. As shown in FIG. 13, the hole 30 also has an outside portion 42 and an inner edge 40. The inner edge 40 connects the hole 30 to the inner rim 38. As shown in FIG. 7, the outer rim 25 has an outside portion 26 and an inside portion 35. The inside portion 35 has threads 36. The threads 36 allow the lid 10 to be securely coupled to the top of a convention cooler. For example, many conventional five-gallon and ten-gallon coolers have threads such that the lid must be twisted or screwed in place. The threads 36 interact with the threads on such coolers and allow the lid 10 to be coupled securely to the tops of such conventional coolers. The inner rim 38, which is depicted in FIG. 10, has an inner surface and an external surface.

Referring to FIGS. 1 and 4, the container 2 has a bottom side 16, an inner side 17, an outer side 18, and an opening 20 on the top of the container 2. The opening 20 is circular. The bottom side 16 is flat so that it can rest on a flat surface, and the inner side 17 and outer side 18 are curved. In the exemplary embodiment shown in FIG. 4, the container 2 also has threads 21. As shown in the preferred embodiment in FIG. 7, the lid 10 has threads 36 that interact with the threads 21 and enable a secure coupling of the lid 10 to the top of the container 2.

Figure 14:
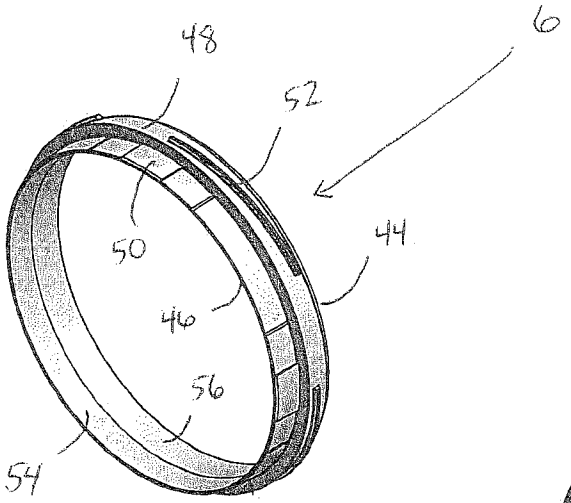
Figure 15:
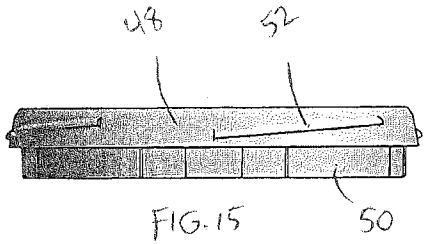
Figure 27:
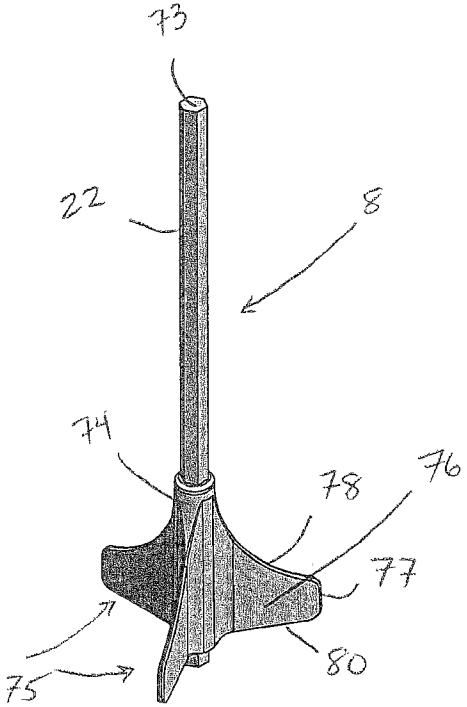
FIGS. 25-28 depict various views of the mixing paddle.
Figure 28:
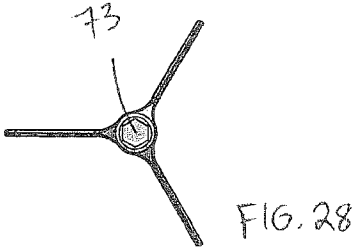
Figure 26:
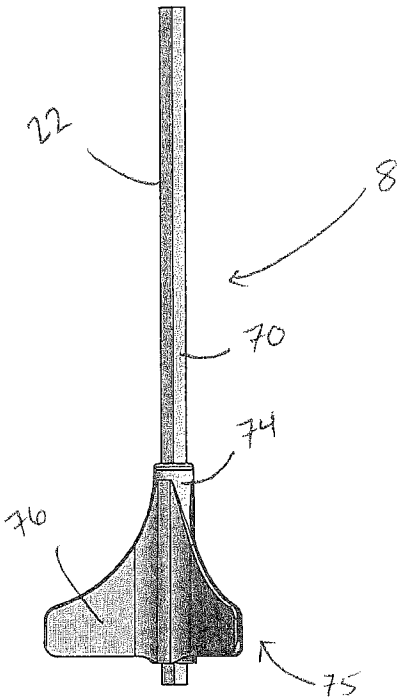
Figure 25:
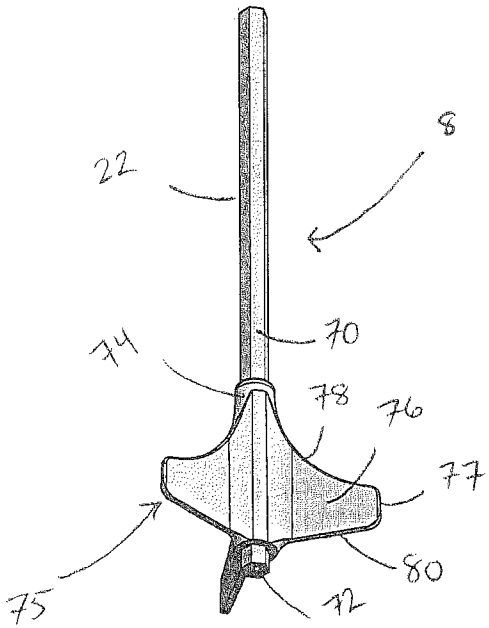
Figure 31:
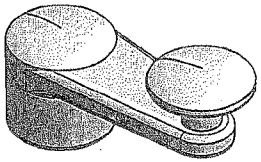
FIGS. 29-37 depict various views of the handle.
Figure 34:
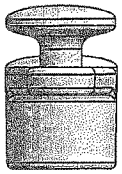
Figure 37:
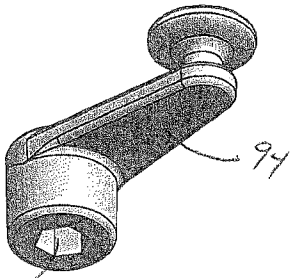
Figure 30:
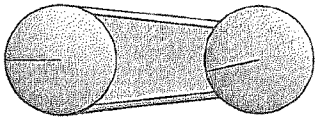
Figure 33:
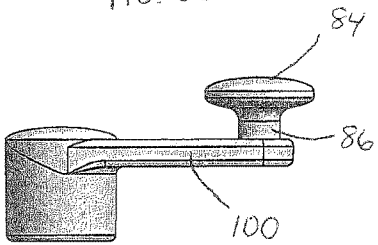
Figure 36:
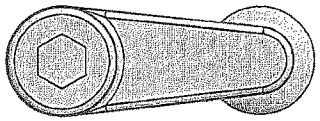
Figure 29:
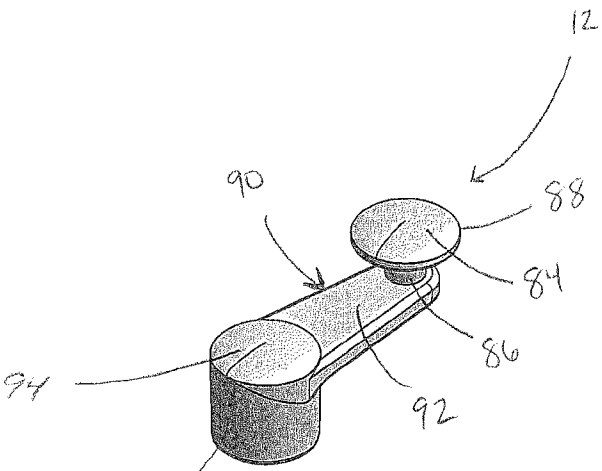
Figure 32:
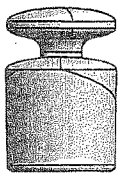
Figure 35:
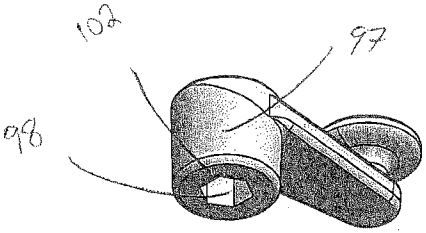
Figure 40:
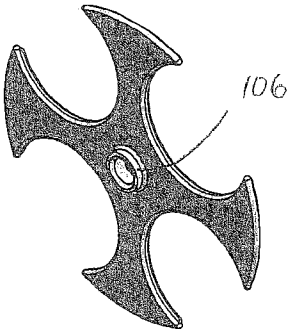
FIGS. 38-42 depict various views of the lower centering guide.
Figure 39:
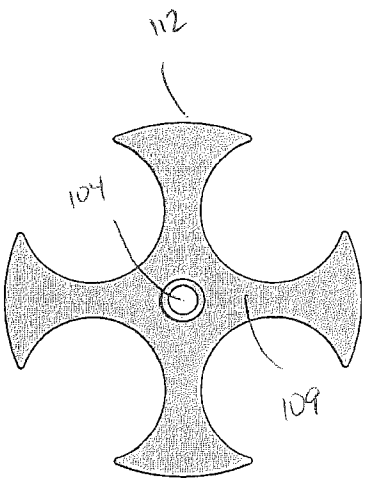
Figure 42:
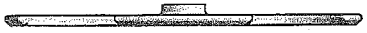
Figure 38:
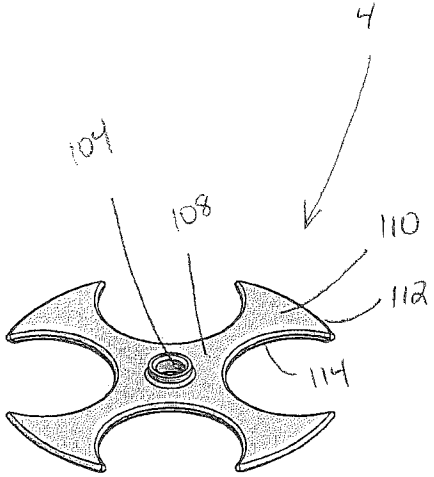
Figure 41:
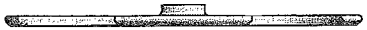
Figures 43, 44, 45, 46:
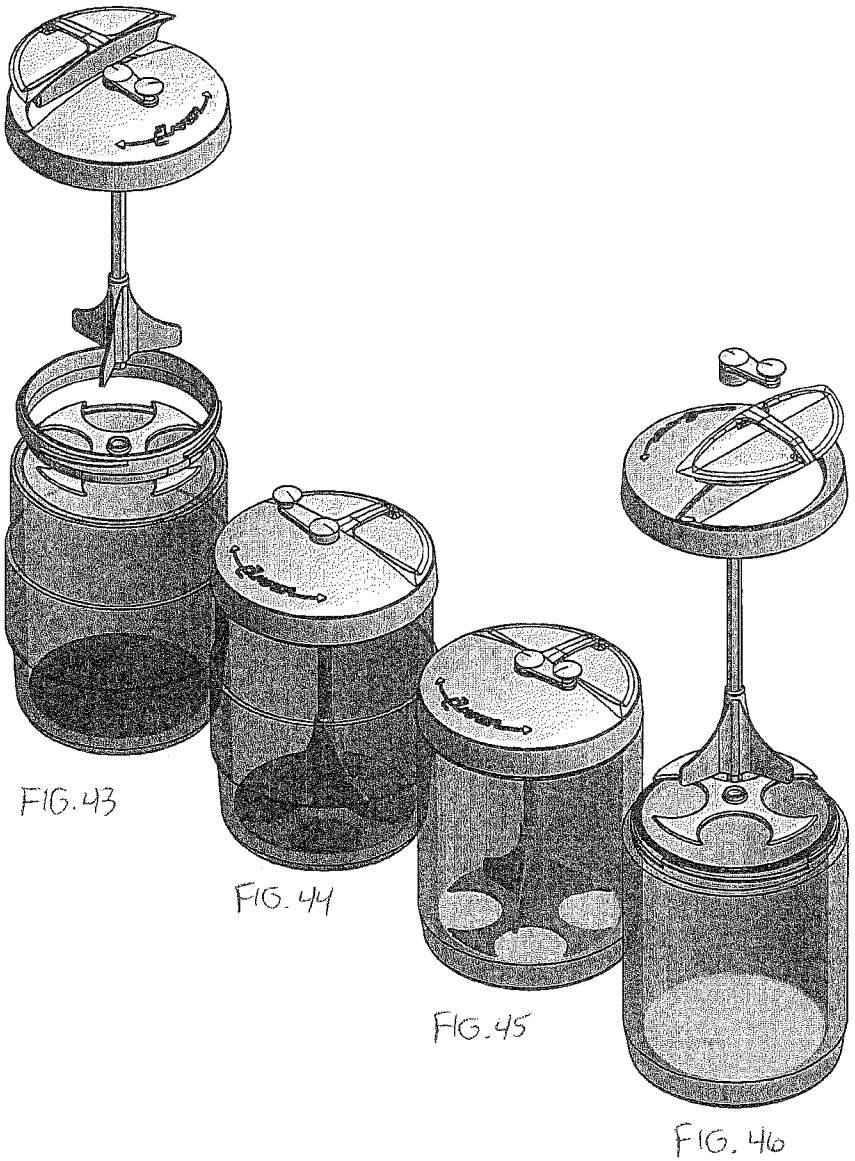
FIG. 43 is an exploded perspective view of the present invention configured for attaching to a non-threaded cooler.
FIG. 44 is a perspective view of the apparatus of FIG. 43.
FIG. 45 is a perspective view of the present invention configured for attaching to a threaded cooler.
FIG. 46 is an exploded perspective view of the apparatus of FIG. 45.

As shown in FIG. 1, other exemplary containers are non-threaded such that the top must be pushed in place. In the exemplary embodiment shown in FIG. 1, the lid 10 is configured for coupling to the top of such a non-threaded container 2 by adding a thread adapter 6 to the top of the container 2. The thread adapter 6 is depicted in FIGS. 14-18. As shown in FIG. 14, the thread adapter 6 is circularly shaped for positioning over the opening 20 of the circular container 2. The thread adapter 6 includes an outer rim 44 and an inner rim 46. The circumference of the outer rim 44 is greater than the circumference of the inner rim 46. The outer rim 44 has an exterior surface 48, an internal surface 56, and threads 52. The threads 52 provide a threaded surface with which the threads 36 of the lid 10 can interact. The inner rim 46 has an external surface 50 and an internal surface 54. In use, if a non-threaded container is provided, the thread adapter 6 is positioned over the opening 20 and the inner rim 46 is coupled to the top of the container 2. When the inner rim 46 is coupled to the top of the container 2, the outer rim 44 protrudes from the top of the container 2 because of its greater circumference. The threads 52 of the outer rim 44 provide a threaded surface with which the threads 36 of the lid 10 can interact. The lid 10 is twisted around the outer rim 44 to allow the threads 36 and 52 to interact. The interaction of the threads 36 and 52 creates a secure coupling between the lid 10 and the outer rim 44 of the thread adapter 6. As shown in FIG. 44, the coupling of the lid 10 to the outer rim 44 creates a secure coupling between the lid 10 and the opening 20.

The cover 14 is configured to close the opening 34 and to couple securely to the lid 10. In an exemplary embodiment, as shown in FIGS. 19-24, the cover 14 includes a top side 62, a bottom side 67, and a grip 58. The top side 62 includes an inner edge 64 and an outer edge 60. The inner edge 64 is flat and configured to abut the flat inside edge 32 of the opening 34. The outer edge 60 is convex and configured to abut the concave outside edge 33 of the opening 34. Similarly, the bottom side 67 includes an inner edge 68 and an outer edge 66. Like the inner edge 64, the inner edge 68 is flat and configured to abut the flat inside edge 32 of the opening 34. Like the outer edge 60, the outer edge 66 is convex and configured to abut the concave outside edge 33 of the opening 34. The grip 58 is bent at an angle to connect the inside edge 64 to the outside edge 60. In use, once the lid 10 is securely coupled to the top of the container 2, contents are added to the container 2 through the opening 34. Once the contents are added, the cover 14 is positioned over the opening 34 and coupled to the lid 10.

In use, the cover 14 ensures that contents of the container 2 do not escape from the container 2 as the mixing assembly operates. If a liquid mixture is inside the container 2, the operation of the mixing assembly may disturb the liquid mixture such that it splashes out of the container 2. By positioning the cover 14 over the opening 34 and securely coupling it to the lid 10, as depicted in FIGS. 44 and 45, all of the liquid mixture stays inside the container 2. For example, if a sports drink solution is desired, water and concentrate are added to the container 2 through the opening 34. The water and concentrate must be stirred at a sufficient speed by the mixing paddle 8 to adequately mix into a solution, and the stirring can cause the solution to splash out of the top of the container 2. The positioning of the cover 14 over the opening 34 and secure coupling to the lid 10 ensures that any splashes are contained inside the container 2.

The centering guide 4 is configured for positioning at the bottom of the inside of the container 2 and coupled to the mixing paddle 8. The centering guide 4 can vary in size according to the size of the container for which it is configured. The centering guide 4 is configured to abut the inner side 17 of the container 2 and provides stability for the mixing paddle 8 to rotate around the bottom of the container 2 to stir the contents therein. Referring to FIGS. 38-42, the centering guide 4 includes a hole 104, a top side 108, a bottom side 109, and arms 110. The hole 104 is located in the middle of the centering guide 4 and is surrounded by a bearing 106. The bearing 106 couples the top side 108 of the centering guide 4 to the mixing paddle 8. The arms 110 include an outside edge 112 and an inside edge 114. The outside edge 112 is convex and configured to abut the curved shaped inner side 17 of the container 2. The inside edge 114 is concave.

The mixing paddle 8 is coupled to the top side 108 of the centering guide 4 and the handle 12. In the preferred embodiment depicted in FIGS. 25-28, the mixing paddle 8 includes a shaft 22, a sleeve 74, and extensions 75 that extend from the sleeve 74. The shaft 22 has a top side 73, a bottom side 72, and an external surface 70. The top side 73 is operatively coupled to the handle 12 through the inner portion 31 of the lid 10. The bottom side 72 is coupled to the bearing 106 on the top side 108 of the centering guide 4. The extensions 75 have sides 76, a top edge 78, an outer edge 77, and a bottom edge 80. The sleeve 74 provides a surface from which the extensions 75 extend. In use, once the top side 73 is operatively coupled to the handle 12, the handle 12 is turned. The turning of the handle 12 causes the shaft 22 and extensions 75 to rotate around the bottom of the container 2. The rotating motion of the extensions 75 causes the stirring of the contents of the container 2. The top edge 78 is curved to decrease resistance as the extensions 75 stir the contents of the container 10. In another exemplary embodiment, the extensions 75 have holes on the sides 76 to further decrease resistance and increase rotational speed.

The handle 12 is operatively coupled to the top side 73 of the shaft 22. In the exemplary embodiments shown in FIGS. 29-37, the handle 12 includes a knob 88, lever 90, a fulcrum 94, and a base 96. The knob 88 has a top portion 84 and a bottom portion 86. The lever 90 has a top side 92, a bottom side 94, and an outer edge 100. The base 96 includes an outer surface 97, a bottom side 102, and a bearing 98. The bearing 98 is configured to securely couple to the top side 73 of the shaft 22. The bottom portion 86 of the knob 88 is coupled to the distal end of the top side 92 of the lever 90. The proximal end of the top side 92 is coupled to the fulcrum 94. The fulcrum 94 is also coupled to the base 96. In use, the lever 90 is rotated in a clockwise or counterclockwise direction by pushing the knob 88 in a clockwise or counterclockwise direction. The coupling of the top side 73 of the shaft 22 to the bearing 98 causes the shaft 22 to rotate in a similarly clockwise or counterclockwise direction. The rotation of the shaft 22 causes the extensions 75 to rotate and stir the contents of the container 10.

In use, the present disclosure is directed to an assembly configured for attaching to a conventional five-gallon or ten-gallon cooler and mixing the contents therein. In a preferred embodiment, the entire apparatus is made of plastic for easier cleaning after use and greater portability.

For example, if a sports drink solution is desired, the centering guide 4 is positioned at the bottom of the inside of the cooler through the opening 20. The convex outside edges 112 of the arms 110 are positioned adjacent to the curved inner side 17. The adjacent positioning stabilizes the centering guide 4. Once the centering guide 4 is stabilized, the bottom side 72 of the mixing paddle 8 is coupled to the bearing 106 on the top side 108 of the centering guide 4.

If the conventional five-gallon or ten-gallon cooler is non-threaded, the thread adapter 6 is positioned over the opening 20. The inner rim 46 is "pushed-on" the top of the non-threaded cooler, and the threads 52 of the outer rim 44 remain exposed. The lid 10 is positioned over the outer rim 44, and the top side 73 of the mixing paddle 8 is positioned through the inside portion 31 of the hole 30. The lid 10 is twisted around the outer rim 44 to allow the threads 36 and 52 to interact. The interaction creates a secure coupling between the lid 10 and the outer rim 44.

If the conventional five-gallon or ten-gallon cooler is threaded, the lid 10 is positioned over the opening 20, and the top side 73 of the mixing paddle 8 is positioned through the inside portion 31 of the hole 30. The lid 10 is twisted around the top of the container 2 to allow the threads 36 and 21 to interact. The interaction creates a secure coupling between the lid 10 and the top of the cooler. With the lid 10 securely coupled to the top of the cooler, the base 96 is also positioned through the inside portion 31 of the hole 30. The positioning of the base 96 through the inside portion 31 allows the top side 73 to couple to the bearing 98. The coupling of the top side 73 to the bearing 98 operatively couples the handle 12 to the mixing paddle 8.

Ice, water, and concentrate are added to the cooler through the opening 34. Once the ice, water, and concentrate are added, the cover 14 is positioned over the opening 34 of the lid 10 and securely coupled thereto. The handle 6 is rotated in a clockwise or counterclockwise direction to cause the shaft 22 to rotate in a similarly clockwise or counterclockwise direction. Because the shaft 22 is connected to the extensions 75, the clockwise or counterclockwise rotation of the shaft 22 causes the extensions 75 to rotate in a similarly clockwise or counterclockwise direction around the bottom of the cooler. The rotation of the extension 75 mixes the ice, water and concentrate in the cooler and causes the contents to reach a homogenous state.

What is claimed is:

1. An apparatus for mixing the contents of a container comprising:

a lid assembly including, a lid having a continuous sidewall with a threaded annular surface coupled to a threaded annular surface of a continuous sidewall of a top of a container and having a hole and an opening to allow for the addition of contents to the container, and a cover configured for coupling to the opening of the lid, and a mixing assembly integrated with the lid assembly through the hole, the mixing assembly including, a centering guide with a top side, a shaft receiving portion in the top side, a bottom side directly supported on a floor of the container, and an outside edge being convex and in direct contact with the continuous sidewall of the container, a mixing paddle including a shaft having a lower end received within the shaft receiving portion, an upper end, and paddle extensions extending radially outwardly from the shaft, and a rotatable handle operatively coupled to the top end of the shaft through the hole in the lid.

2. The apparatus of claim 1 wherein the handle is mechanically coupled to the top end of the shaft by a bearing.

3. The apparatus of claim 1 wherein the handle is electronically coupled to the top end of the shaft.

4. The apparatus of claim 1 wherein the lower end of the shaft is coupled to the top side of the centering guide by a bearing.

5. The apparatus of claim 1 wherein the handle includes a lever that rotates in a clockwise or counterclockwise direction.

6. A method of mixing the contents of a container comprising:

coupling the apparatus of claim 1 to the container, adding contents to the container through the opening in the lid, covering the opening with the cover, operating the mixing paddle by turning the handle, and stirring the contents in the container.

7. An apparatus for mixing the contents of a cooler comprising:

a lid assembly including, a lid having a continuous sidewall with a threaded annular surface coupled to a threaded annular surface of a continuous sidewall of a top of the cooler and having a hole and an opening to allow for the addition of contents to the cooler, and a cover capable of being securely coupled to the lid to cover the opening, and a mixing assembly integrated with the lid assembly through a hole in the lid, the mixing assembly including, a centering guide having a flat bottom surface directly abutting a floor of the cooler and an outside edge directly abutting a bottom portion of the continuous sidewall of the cooler, a mixing paddle including shaft having an upper end and a lower end directly engaged with the centering guide, and paddle extensions extending radial outwardly from the shaft, and a handle operatively coupled to the top end of the shaft.

8. The apparatus of claim 7 wherein the cooler is a five-gallon cooler.

9. The apparatus of claim 7 wherein the cooler is a ten-gallon cooler.

10. A method of mixing the contents of a container comprising:

coupling the apparatus of claim 7 to the cooler, adding contents to the cooler through the opening in the lid, covering the opening with the cover, operating the mixing paddle by turning the handle, and stirring the contents in the cooler.

11. An apparatus for mixing the contents of a cooler having a non-threaded top, the apparatus comprising:

a lid assembly including, a lid having a continuous sidewall with a threaded annular surface, a central hole and an opening to allow for the addition of contents through the lid and into the cooler, a thread adapter with a first annular rim configured for directly coupling to the non-threaded top of the cooler and a second annular rim having a continuous sidewall with a threaded annular surface configured for coupling to the lid, a cover capable of being securely coupled to the lid to cover the opening, and a mixing assembly integrated with the lid assembly and extending through the central hole in the lid, the mixing assembly including, a centering guide with a top side, a shaft receiving portion in the top side, a bottom side directly supported on a floor of the container, and an outside edge being convex and in direct contact with a curved shaped inner side of the container, a mixing paddle including a shaft having a lower end received within the shaft receiving portion, an upper end, and paddle extensions extending radially outwardly from the shaft, and a rotatable handle operatively coupled to the top end of the shaft through the hole in the lid.

12. The apparatus of claim 11 wherein the cooler is a five-gallon cooler.

13. The apparatus of claim 11 wherein the cooler is a ten-gallon cooler.

14. The apparatus of claim 11 wherein the outer rim of the thread adapter has threads.

15. A method of mixing the contents of a container comprising:

coupling the apparatus of claim 11 to the cooler by pushing the first rim of the threaded adapter into the non-threaded top of the cooler, followed by screwing the lid onto the threaded adapter, adding contents to the cooler through the opening in the lid, covering the opening with the cover, operating the mixing paddle by turning the handle, and stirring the contents in the cooler.

* * * * *